US007538733B2

(12) United States Patent
Isogai

(10) Patent No.: US 7,538,733 B2
(45) Date of Patent: May 26, 2009

(54) INFORMATION COMMUNICATION DEVICE

(75) Inventor: Shoichi Isogai, Aichi (JP)

(73) Assignee: Sony Computer Entertainment Inc., Tokyo (JP)

( * ) Notice: Subject to any disclaimer, the term of this patent is extended or adjusted under 35 U.S.C. 154(b) by 144 days.

(21) Appl. No.: 11/779,461

(22) Filed: Jul. 18, 2007

(65) Prior Publication Data

US 2009/0021430 A1 Jan. 22, 2009

(51) Int. Cl.
*H01Q 1/24* (2006.01)
*H01Q 1/48* (2006.01)

(52) U.S. Cl. ..... 343/702; 343/846

(58) Field of Classification Search ..... 343/702, 343/846, 700 MS
See application file for complete search history.

(56) References Cited

U.S. PATENT DOCUMENTS 6,326,919 B1 * 12/2001 Diximus et al. ..... 343/700 MS
6,614,401 B2 * 9/2003 Onaka et al. ..... 343/702
7,142,160 B2 * 11/2006 Furuno et al. ..... 343/700 MS

* cited by examiner

*Primary Examiner*—Hoang V Nguyen
(74) *Attorney, Agent, or Firm*—Katten Muchin Rosenman LLP

(57) ABSTRACT

An information communication device comprises a board containing a ground pattern having a prong pattern portion, and an antenna element provided on or over the prong pattern portion of the ground pattern of the board and having an oblique surface, which contains at least a part of a radiation board, to the ground pattern.

4 Claims, 6 Drawing Sheets

INFORMATION COMMUNICATION DEVICE

BACKGROUND OF THE INVENTION

1. Field of the Invention

The present invention relates to an information communication device for transmitting and receiving information by means of radio.

2. Related Arts

A polarization diversity communication system for exchanging information using radio signals that are vertically and horizontally polarized is available. In carrying out polarization diversity communication, two antennas for transmitting and receiving radio signals with vertical and horizontal polarization respectively are used. For example, an antenna formed within a printed wiring board in an electronic device and an antenna vertically erected on the printed wiring board are used. As the dispositions of the respective antennas are subjected to restriction due to the structure of a device enclosure, an inverted-F antenna is often employed for the antenna vertically erected on the printed wiring board to suppress the height.

A typical inverted-F antenna shows a directivity pattern of a component perpendicular to the board surface, which is similar to that of a dipole antenna, as shown in FIG. 8. That is, there exists a null point depending on direction. Therefore, it may not be possible to ensure that a signal having sufficient strength is directed to a certain communication destination in a particular direction, depending on the manner in which the enclosure of the product is disposed.

SUMMARY OF THE INVENTION

According to one aspect of the present invention, there is provided a radio communication device capable of maintaining polarization in the direction perpendicular to the board surface at a certain level or more over the entire circumference thereof.

According to another aspect of the present invention, there is provided an information communication device comprising a board containing a ground pattern having a prong portion, and an antenna element provided on or over the prong portion of the ground pattern of the board and having an oblique surface, which is at least a part of a radiation board, to diagonal contact with the ground pattern.

BRIEF DESCRIPTION OF THE DRAWINGS

An embodiment of the present invention will be described with reference to the accompanying drawings, wherein.

DESCRIPTION OF THE PREFERRED EMBODIMENT

Figure 1:
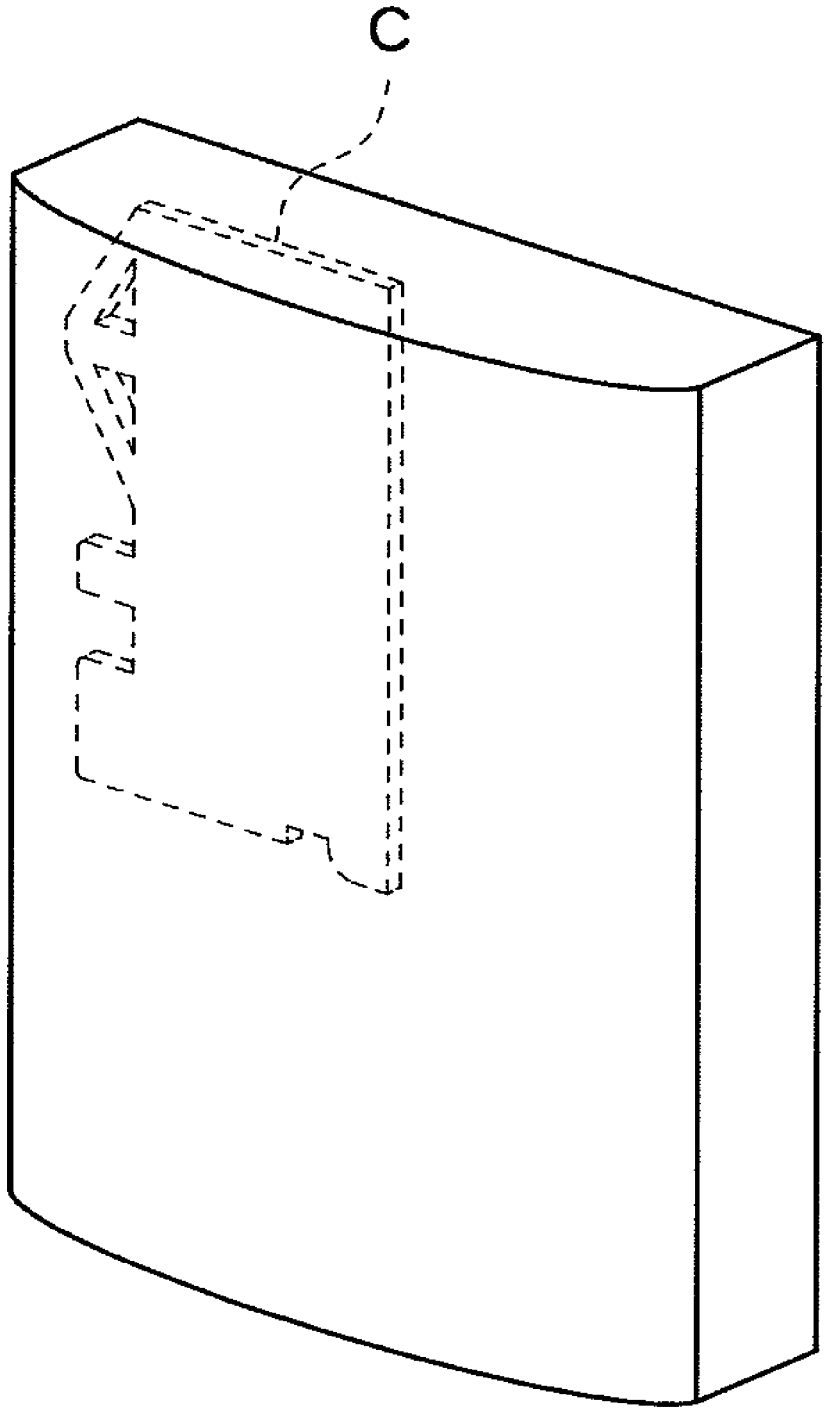
FIG. 1 is a diagram showing an information communication device which is standing upright according to an embodiment of the present invention.

An information communication device 1 according to an embodiment of the present invention comprises a box-like thin enclosure, as shown in FIG. 1, having a circuit board C accommodated therein. The circuit board C is fixed inside the enclosure substantially parallel to the surface having the largest area (hereinafter referred to as a main surface) of the enclosure.

Figure 2:
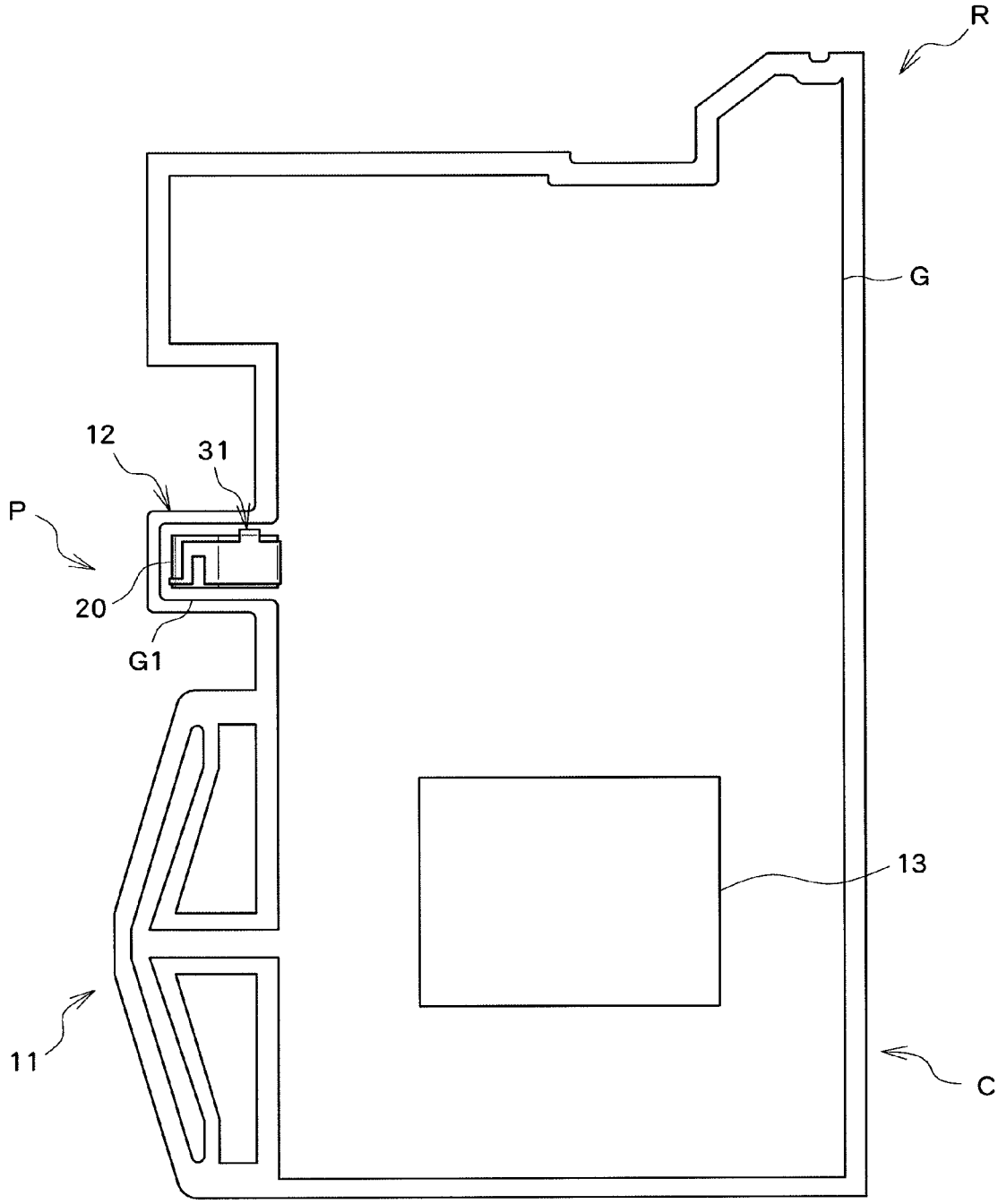
FIG. 2 is a diagram showing an example of a circuit board of the information communication device according to the embodiment of the present invention.
Figure 3:
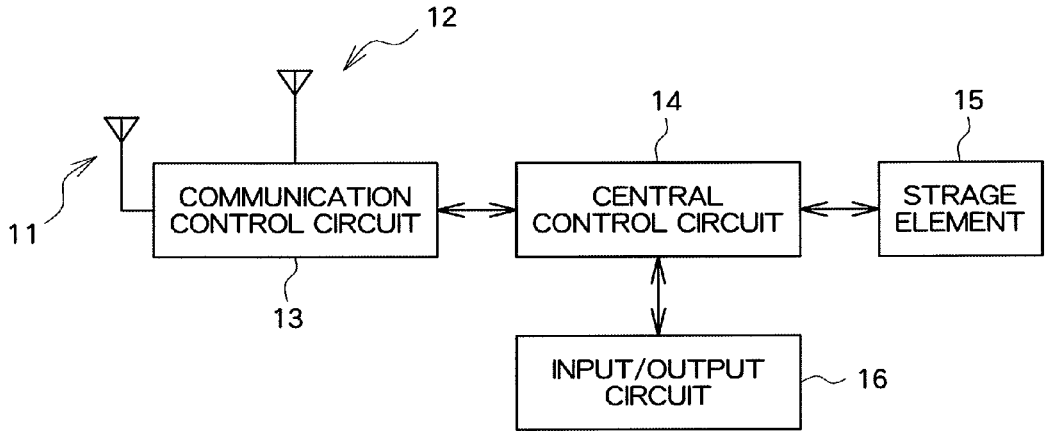
FIG. 3 is a structural block diagram of an example of the information communication device according to the embodiment of the present invention.

This circuit board C is a printed wiring board with an electrical line formed thereon, and comprises a substantially rectangular portion (hereinafter referred to as a main portion) R and a peninsula-like projected portion P which extends outwards from the main portion R, as shown in FIG. 2. On the circuit board C, a circuit comprising a first antenna 11, a second antenna 12, and a communication control circuit 13 is formed. The communication control circuit 13 is connected to a circuit comprising a central control circuit 14, a storage element 15, and an input/output circuit 16, as shown in FIG. 3. The central control circuit 14, the storage element 15, and the input/output circuit 16 may be formed either on the circuit board C or on a different circuit board.

The first antenna 11, which is formed as a print pattern on the circuit board C, is a dipole antenna having a main plane of polarization parallel to the circuit board C, for example. The first antenna 11 radiates a signal received from the communication control circuit 13, and also receives a signal arriving from the outside, and outputs to the communication control circuit 13.

The second antenna 12, which is an antenna having a main plane of polarization perpendicular to the circuit board C, radiates a signal received from the communication control circuit 13, and also receives a signal arriving from the outsides, and outputs to the communication control circuit 13.

Figure 4:
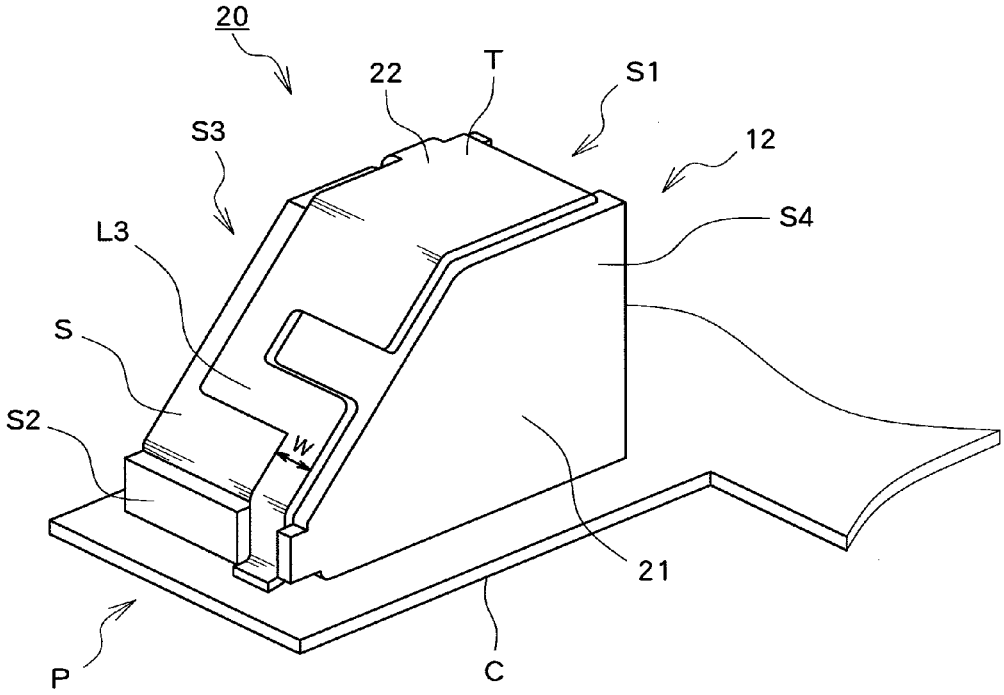
FIG. 4 is a perspective illustration showing an antenna of the information communication device according to the embodiment of the present invention.

The second antenna 12 specifically includes an antenna body 20 standing on the peninsula-like projected portion of the circuit board C, as shown in FIG. 4. On the peninsula-like projected portion P of the circuit board C where the antenna body 20 stands, a prong ground pattern G1 is formed along the projected shape. The prong ground pattern G1 is extended from the ground pattern on the main portion R of the circuit board C. The prong ground pattern G1 has tongue-like shape, and it is not necessary to have a sharp edge.

Figure 5A:
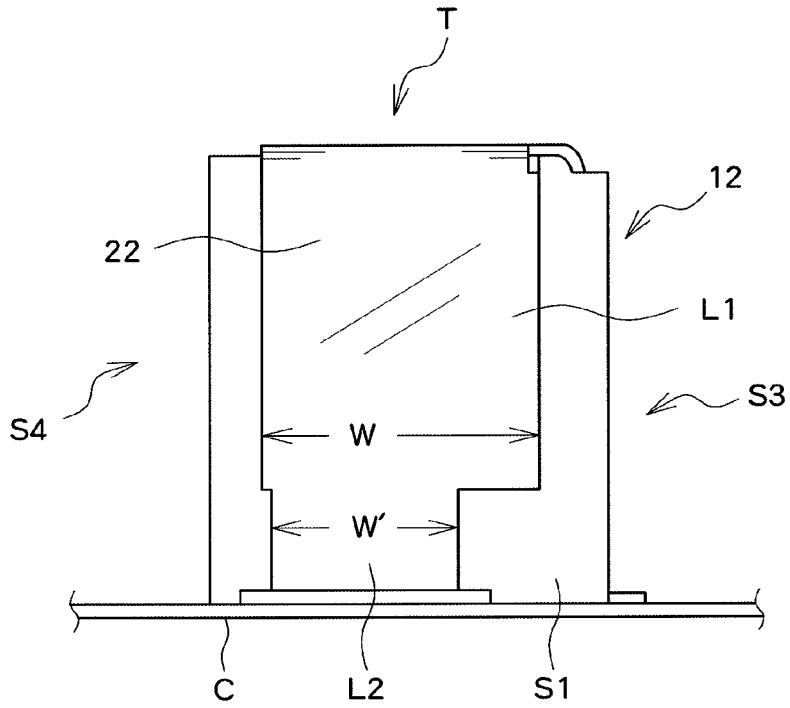
FIG. 5A is a rear view showing the antenna of the information communication device according to the embodiment of the present invention.
Figure 5B:
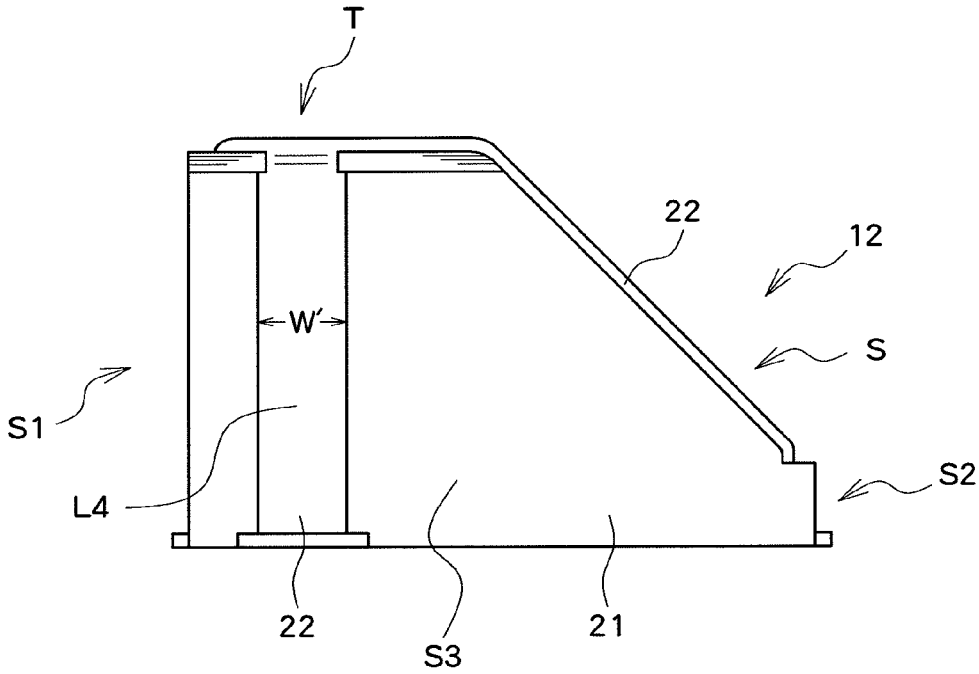
FIG. 5B is a side view showing the antenna of the information communication device according to the embodiment of the present invention.

The antenna body 20 comprises a support body 21 and an antenna element 22 formed along the support body 21, as shown in FIG. 4. Specifically, the support body 21 has a rectangular parallelepiped having a chamfered part and a bottom surface in contact with the circuit board surface C. That is, the support body 21 comprises opposing rectangular side surfaces S1, S2, opposing trapezoid side surfaces S3, S4, and a rectangular top surface T. The top surface T is narrower than the bottom surface. FIG. 4 is a perspective illustration showing the second antenna 12 of a device according to the embodiment of the present invention. FIG. 5A is a rear view of the second antenna 12 viewed from the back surface thereof (S1). FIG. 5B is a side view of the second antenna 12 viewed from the lateral side thereof.

The antenna element 22 has a conductive pattern which extends from the rectangular side surface S, or a part of the support body 21, to the top surface T and the chamfered surface (that is, the slope, or the oblique surface S) and finally reaches the side surface S2 on the other side, as shown in FIGS. 4 and 5A. The conductive pattern of the antenna element 22 additionally extends from the top surface T to one of the trapezoid side surfaces (S3 or S4) and finally reaches a feeding point 31 on the circuit board C. The conductive pattern of the antenna element 22 constitutes a line L1 having a predetermined width W on the rectangular side surface S1 of the support body 21, then becoming a line L2 having a width W' narrower than the width W in the vicinity of the circuit board C to be finally in contact with the ground pattern on the circuit board C.

On the oblique surface S, the conductive pattern of the antenna element 22 constitutes a line L3 having a width w smaller than the width W and bending in a step-like manner. On the trapezoid side surface S3 on the other side, the conductive pattern of the antenna element 22 constitutes a line L4 having the width w' and being in contact with a fixed electrode on the circuit board C, as shown in FIG. 5B. The fixed electrode on the circuit board C is an electrode which is electrically insulated from the ground pattern and the feeding point.

The antenna body 20 of the second antenna 12 is situated on a portion (the prong pattern) of the ground pattern which projects like a peninsula on the circuit board. The conductive pattern of the antenna element 22 is contained on the oblique surfaces to the prong pattern portion of the ground pattern.

Figure 6A:
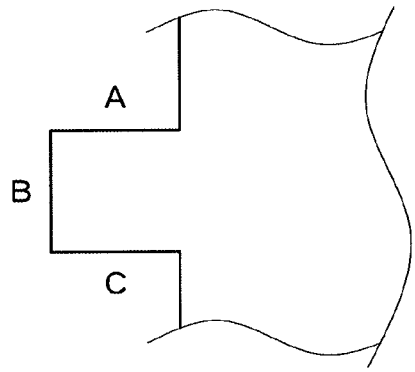
FIG. 6A is a schematic diagram showing an example of a ground pattern of an antenna portion of the information communication device according to the embodiment of the present invention.
Figure 6B:
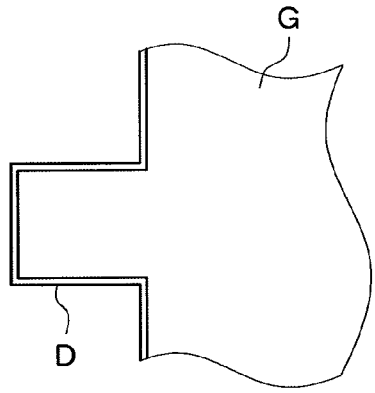
FIG. 6B is a schematic diagram showing an example of formation of a ground pattern of the antenna portion of the information communication device according to the embodiment of the present invention.
Figure 6C:
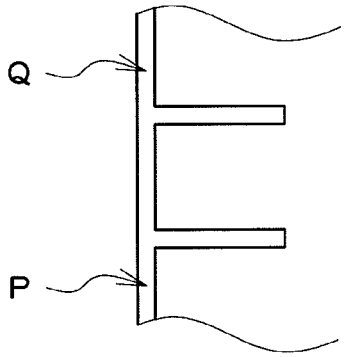
FIG. 6C is a schematic diagram showing another example of formation of the ground pattern of the antenna portion of the information communication device according to the embodiment of the present invention.

Here, it should be noted that formation of a peninsula-like prong pattern of a ground pattern is achieved by forming a polygon having N number of sides (an N-gon) with the N-1 number of sides separated from the circumferential ground pattern. For example, as shown in FIG. 6A, the three sides A, B, C of a rectangular pattern may be formed separated from the circumferential ground pattern. In order to form a shape separated from the circumferential ground pattern, the board D itself may be formed projecting, as shown in FIG. 6B, while providing the ground pattern G along the projected shape. In the above, separation from the circumferential ground pattern is essential, and existence of ground patterns (P, Q) close to the prong pattern as shown in FIG. 6C, is acceptable.

The communication control circuit 13 is a circuit for processing a signal according to a radio communication standard, such as Bluetooth, or the like, for example. The communication control circuit 13 feeds electricity to the first antenna 11 and the second antenna 12 via a feeding point. Upon receipt of information to be transmitted from the central control circuit 14, or the like, the communication control circuit 13 modulates the information into a modulated signal, and supplies the modulated signal to the first and second antennas 11, 12, which in turn radiate the signal by means of radio. Also, the communication control circuit 13 receives a signal arriving at the first and second antennas 11, 12, then decodes the received signal to obtain information, and outputs to the central control circuit 14.

The central control circuit 14 is a program control device, such as a CPU, or the like, and operates according to a program stored in the storage element 15. Upon receipt of an instruction to perform radio transmission to an external device, the central control circuit 14 outputs information to the communication control circuit 13 according to a program stored in the storage element 15. Further, upon receipt of information received by the communication control circuit 13, the central control circuit 14 carries out a process utilizing the received information.

The storage element 15 comprises a RAM (Random Access Memory), a ROM (Read Only Memory), or the like, and stores a program copied from a recording medium (not shown), or the like. The storage element 15 also operates as a work memory for holding information for use in a process by the central control circuit 14.

The input/output circuit 16 is connected to the central control circuit 14 and a display (including a home-use television, or the like) serving as an external input/output device. This input/output circuit 16 outputs a video signal to the display, or the like, according to an instruction input from the central control circuit 14.

In the information communication device 1 in this embodiment, the central control circuit 14, for example, executes a game program, or the like, and receives a user operation sent by radio from a game controller serving as an external device. The radio signal may be a signal according to Bluetooth standard, for example.

The game controller generally has a longitudinal shape so that the user can readily operate the game controller while grasping using both hands. Therefore, the antenna of the game controller is resultantly located in the horizontal direction, with a radio signal having horizontal polarization.

According to the information communication device 1 in this embodiment, when the information communication device 1 is placed with the enclosure thereof extending in the horizontal direction such that the circuit board C is laid parallel to the floor surface where the user holding the game controller sits or stands on, the first antenna 11, which has the main plane of polarization parallel to the floor surface, receives a signal from the game controller. The communication control circuit 13 decodes the received signal to obtain information describing the content of the user operation, and outputs to the central control circuit 14, which in turn utilizes the information in a game process.

The central control circuit 14 also outputs information to the game controller. In this case, the central control circuit 14 outputs information to the communication control circuit 13, which in turn modulates the received information, and then outputs to the first antenna 11 and the second antenna 12. As the first antenna 11 radiates a radio signal having a main plane of polarization parallel to the circuit board C and the information communication device 1 is placed with the enclosure thereof extending in the horizontal direction here, the radio signal radiated by the first antenna 11 constitutes a signal having a horizontal plane of polarization. Meanwhile, as the second antenna 12 radiates a radio signal having a main plane of polarization perpendicular to the circuit board C, the signal radiated by the second antenna 12 constitutes a radio signal having a vertical plane of polarization in this example.

When the information communication device 1 is placed with the enclosure thereof extending in the horizontal direction, as described above, the game controller receives a signal mainly from the first antenna 11, or a signal having horizontal polarization.

In the following, a case in which the information communication device 1 is placed with the enclosure thereof standing upright, such that the surface on which the circuit board C is formed is placed perpendicular to the floor surface, will be described.

In this case, a signal having horizontal polarization radiated by the game controller constitutes a signal having polarization perpendicular to the circuit board C. Therefore, the signal radiated by the game controller is received by the second antenna 12, which has a main plane of polarization perpendicular to the circuit board C. The communication control circuit 13 decodes the received signal to obtain information describing the content of the user operation, and outputs to the central control circuit 14, which in turn utilizes the information in a game process.

In order for the central control circuit 14 to output information to the game controller, the central control circuit 14 outputs information to the communication control circuit 13, which in turn modulates the received information, and outputs to the first antenna 11 and the second antenna 12. As the first antenna 11 radiates a radio signal having a main plane of polarization parallel to the circuit board C and the information communication device 1 is placed with the enclosure thereof standing upright here, a radio signal radiated by the first antenna 11 constitutes a signal having vertical polarization. Meanwhile, as the second antenna 12 radiates a radio signal having a main plane of polarization perpendicular to the circuit board C, the signal radiated by the second antenna 12 constitutes a radio signal having horizontal polarization in this example.

Figure 7:
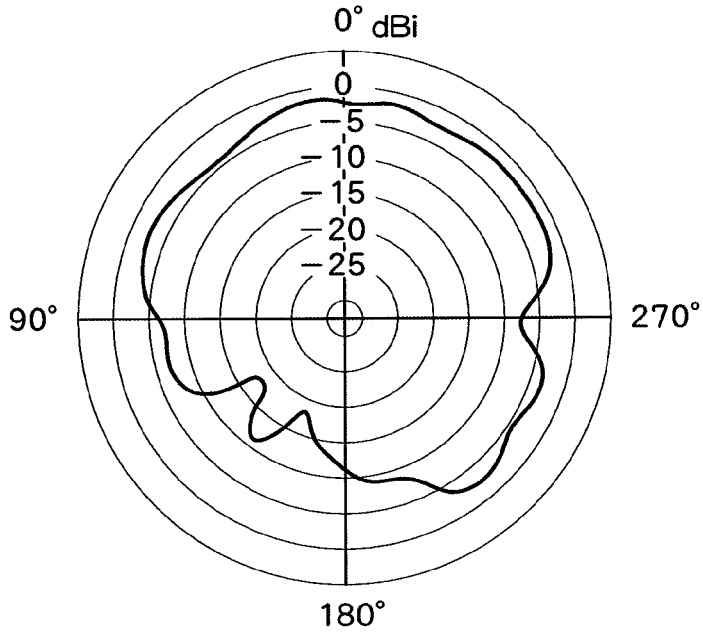
FIG. 7 is a diagram explaining an example of a radiation pattern of the antenna according to the embodiment of the present invention.

The second antenna 12 in this embodiment presents a radiation pattern of the main polarization thereof, such as is shown in FIG. 7, in which a signal having a gain of at least −20 dBi or more is radiated in almost all circumference directions of the relevant information communication device 1. In FIG. 7, the 90 degree and −270 degree directions are directions normal to the main surface of the enclosure, that is, the directions of the user who faces to the main surface of the enclosure.

Figure 8:
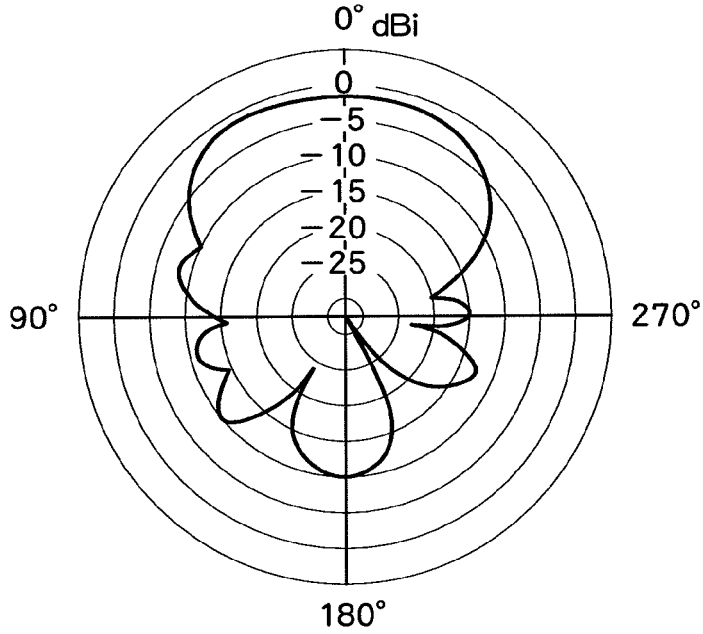
FIG. 8 is a diagram explaining an example of a radiation pattern of a typical inverted-F antenna.

Meanwhile, a general inverted-F antenna presents a radiation pattern, as shown in FIG. 8, in which, although a signal of enough strength is radiated to the 0 degree direction, a signal having a gain −20 dBi or lower is radiated to certain points between the 90 degree and 270 degree directions. Moreover, in the 215 degree direction, there is a null point with a gain (antenna gain) of −30 dBi or lower. Therefore, according to this general inverted-F antenna, preferable communication with a game controller may not be readily established when the information communication device 1 is placed with the enclosure thereof standing upright, depending on the position of the user.

Meanwhile, according to the second antenna 12 in this embodiment, preferable communication with the game controller is established and maintained regardless of the user's position.

While the present invention is described in terms of preferred or exemplary embodiments, it is not limited thereto.

What is claimed is:

1. An information communication device, comprising:

a board containing a ground pattern having a prong pattern portion; and an antenna element provided on or over the prong pattern portion of the board and having an oblique surface, which is at least a part of a radiation board, to the ground pattern.

2. The information communication device according to claim 1, wherein the radiation board of the antenna element has a first portion contained on a surface substantially parallel to the ground pattern, and a second portion contained on the oblique surface to the ground pattern.

3. The information communication device according to claim 1, wherein the part of the radiation board contained on the oblique surface to the ground pattern contains a bending pattern.

4. The information communication device according to claim 1, wherein the prong pattern constitutes a polygon having an N number of sides with an N-1 number of sides being separated from a circumferential ground pattern.

* * * * *